US009112296B2

(12) United States Patent
Zhang

(10) Patent No.: US 9,112,296 B2
(45) Date of Patent: Aug. 18, 2015

(54) ELECTRICAL CONNECTOR WITH HIGH RELIABILITY

(71) Applicant: HON HAI PRECISION INDUSTRY CO., LTD., New Taipei (TW)

(72) Inventor: Wei-De Zhang, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/258,226

(22) Filed: Apr. 22, 2014

(65) Prior Publication Data

US 2014/0315439 A1 Oct. 23, 2014

(30) Foreign Application Priority Data

Apr. 23, 2013 (CN) ..... 2013 2 02073493 U

(51) Int. Cl.

| | |
|---|---|
| ***H01R 13/648*** | (2006.01) |
| ***H01R 13/516*** | (2006.01) |
| ***H01R 13/52*** | (2006.01) |
| *H01R 12/72* | (2011.01) |
| *H01R 13/6594* | (2011.01) |

(52) U.S. Cl.

CPC ..... *H01R 13/516* (2013.01); *H01R 13/521* (2013.01); *H01R 12/724* (2013.01); *H01R 13/5219* (2013.01); *H01R 13/6594* (2013.01)

(58) Field of Classification Search

CPC ..... H01R 23/65802; H01R 13/2442

USPC ..... 439/607.01, 701, 260, 626

See application file for complete search history.

(56) References Cited

U.S. PATENT DOCUMENTS

| | | | | |
|---|---|---|---|---|
| 7,534,140 | B2 * | 5/2009 | Zheng et al. | 439/607.01 |
| 7,682,199 | B2 | 3/2010 | Ahn et al. | |
| 7,824,219 | B2 * | 11/2010 | Wang | 439/607.27 |
| 7,914,299 | B2 * | 3/2011 | Lee | 439/76.1 |
| 8,262,414 | B1 | 9/2012 | Li et al. | |
| 8,292,662 | B2 | 10/2012 | Yang et al. | |
| 2012/0315779 | A1 | 12/2012 | Yudate et al. | |
| 2014/0302709 | A1 * | 10/2014 | Zhao et al. | 439/519 |

FOREIGN PATENT DOCUMENTS

| | | |
|---|---|---|
| JP | 2002-298983 | 10/2002 |
| KR | 20090082760 | 7/2009 |
| WO | 2012124261 | 9/2012 |

* cited by examiner

*Primary Examiner* — Phuongchi T Nguyen

(74) *Attorney, Agent, or Firm* — Ming Chieh Chang; Wei Te Chung

(57) ABSTRACT

An electrical connector (100) includes an insulative housing (2), a number of contacts (3) retained in the insulative housing, a metal shield (4) covering the insulative housing for defining a receiving space, an insulative cover (5) insert-molded outside of the metal shield, and a metal frame (6) retained in the insulative cover. The metal frame includes a transverse arm (61) and a pair of vertical arms (62) extending downwardly from two distal ends of the transverse arm for reinforcing the metal shield from three sides of the metal shield.

9 Claims, 6 Drawing Sheets

ELECTRICAL CONNECTOR WITH HIGH RELIABILITY

BACKGROUND OF THE INVENTION

1. Field of the Invention

The present invention relates generally to an electrical connector, and more particularly to an electrical connector with high reliability to undertake large insertion force of a mating connector.

2. Description of Related Arts

U.S. Pat. No. 8,292,662 discloses a watertight electrical connector having an insulating housing, a plurality of terminals mounted into the insulating housing, a shell wrapping the insulating housing, and a fixing element fixing the shell on a printed circuit board (PCB). The fixing element is fixed on the shell by means of laser welding. The fixing element has a pair of lateral slices fixed on lateral plates of the shell sealing first through holes of the shell. The fixing element has a base slice fixed under the shell and sealing second through holes of the shell. U.S. Pat. No. 8,262,414 issued on Sep. 11, 2012, discloses a connector including, among others, a first shell and a second shell fixed on the first shell for strengthening elastic arms of the first shell. The connector is fixed on a printed circuit board (PCB) by means of the first shell and the second shell so it can be fixed to the PCB firmly.

An electrical connector sturdy to undertake large insertion force of a mating connector and simple to manufacture, with improved waterproof effect, is desired.

SUMMARY OF THE INVENTION

Accordingly, an object of the present invention is to provide an electrical connector with high reliability to undertake large insertion force of a mating connector, simply manufacturing, and better waterproof effect.

To achieve the above object, an electrical connector includes an insulative housing, a number of contacts retained in the insulative housing, a metal shield covering the insulative housing for defining a receiving space, an insulative cover insert-molded outside of the metal shield, and a metal frame retained in the insulative cover. The metal frame includes a transverse arm and a pair of vertical arms extending downwardly from two distal ends of the transverse arm for reinforcing the metal shield from three sides of the metal shield.

Other objects, advantages and novel features of the invention will become more apparent from the following detailed description when taken in conjunction with the accompanying drawings.

DETAILED DESCRIPTION OF THE PREFERRED EMBODIMENT

Figure 1:
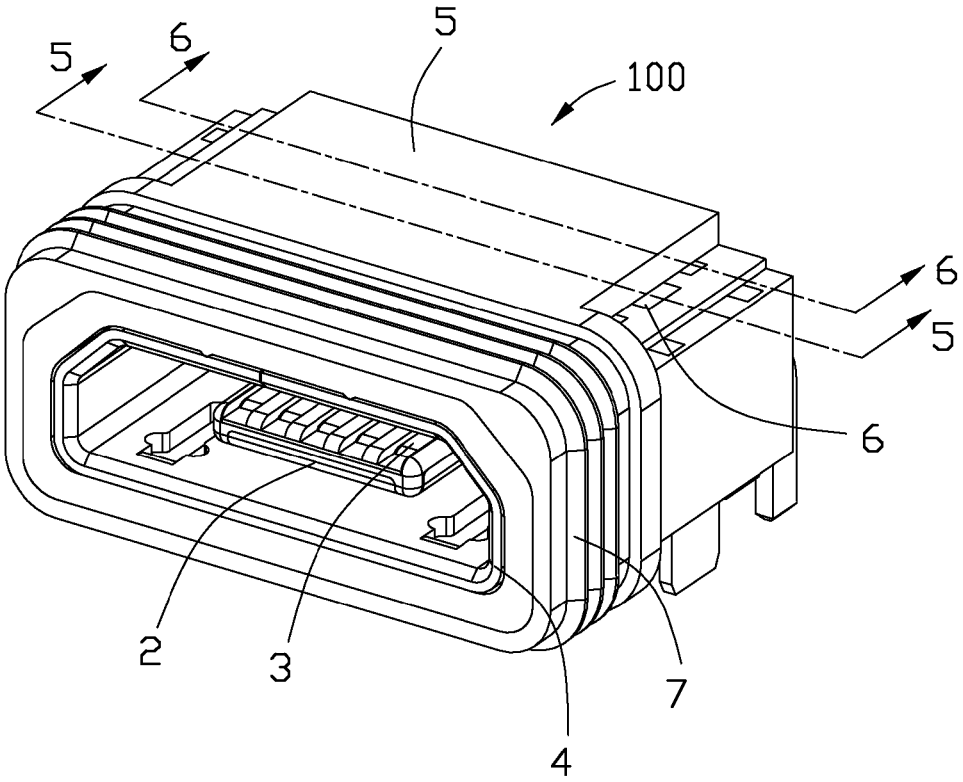
FIG. 1 is a perspective, assembled view of an electrical connector constructed in accordance with the present invention.
Figure 2:
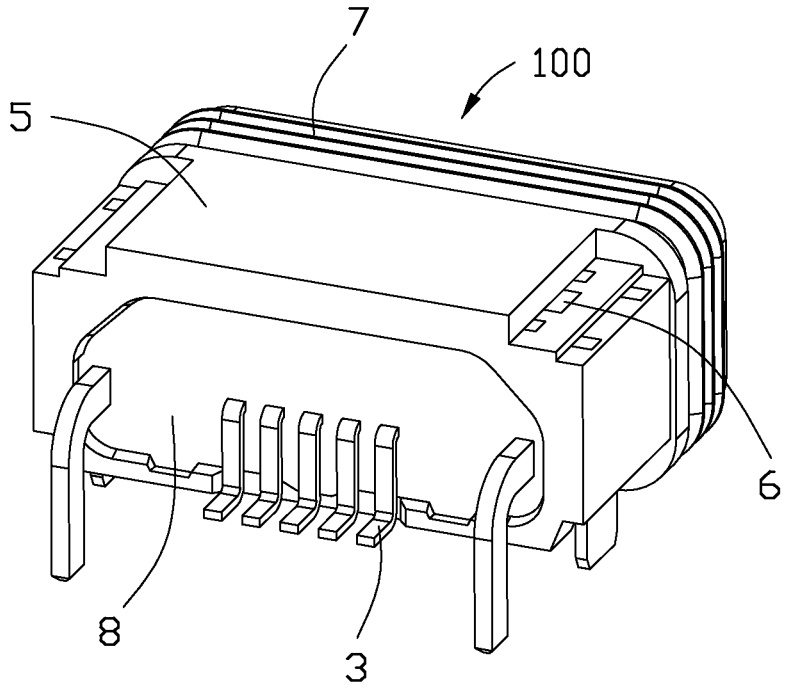
FIG. 2 is similar to FIG. 1 but taken from a different aspect.

Reference will now be made in detail to the preferred embodiment of the present invention.

Referring to FIGS. 1-6, an electrical connector 100 of the present invention comprises an insulative housing 2, a plurality of contacts 3 retained in the insulative housing 2, a metal shield 4 covering the insulative housing 2 for defining a receiving space 40 with an insertion opening 401 for receiving a mating connector (not shown), an insulative cover 5 insert-molded outside of the metal shield 4, a metal frame or bracket 6 retained in the insulative cover 5, a waterproof ring 7 assembled around a front part of the insulative cover 5, and a waterproof glue block 8 interposed in the insulative cover 5 by cooling, solidifying, and terminating at a rear of the insulative housing 2.

Figure 3:
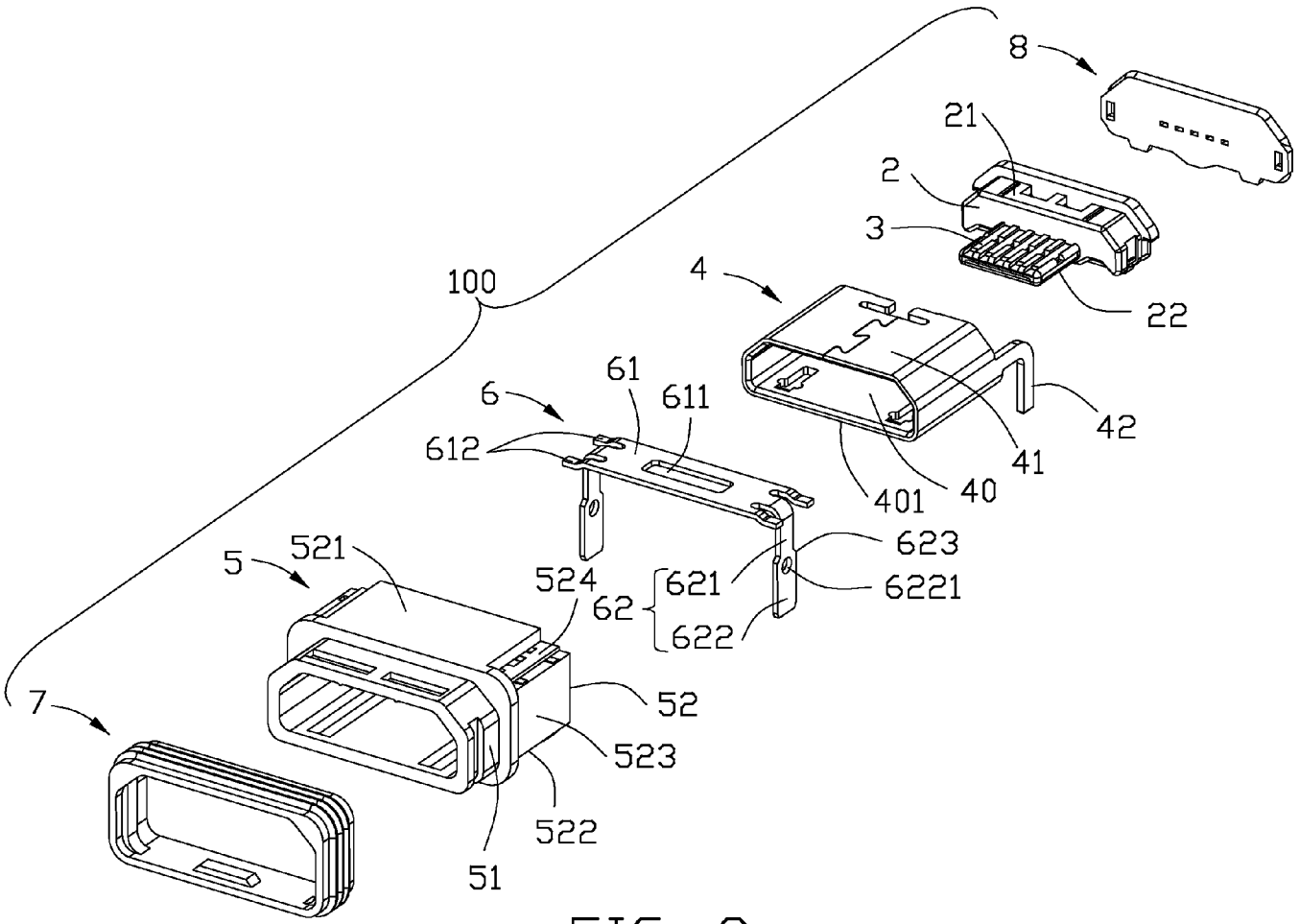
FIG. 3 is a perspective, exploded view of the electrical connector.
Figure 4:
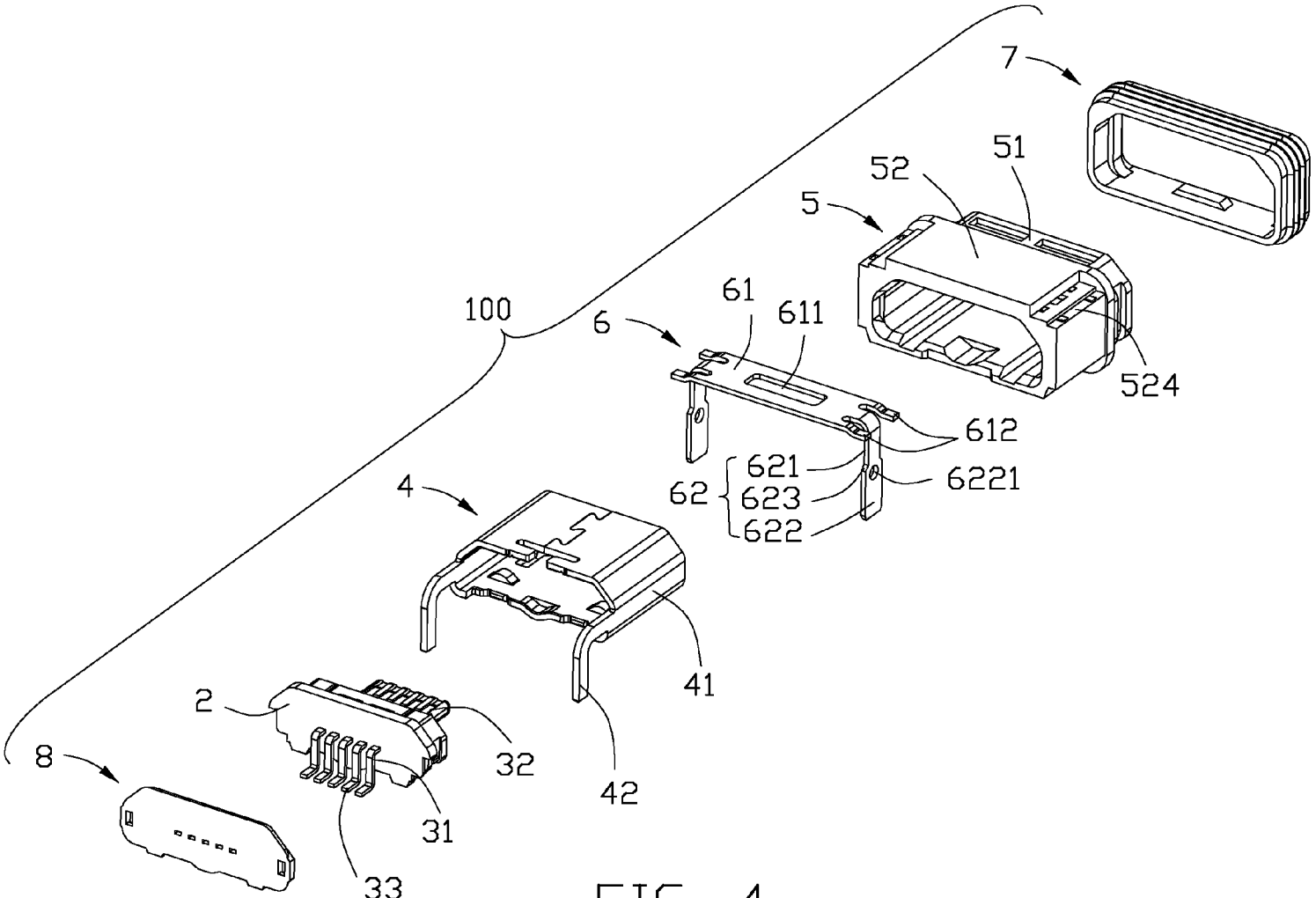
FIG. 4 is similar to FIG. 3 but taken from a different aspect.
Figure 5:
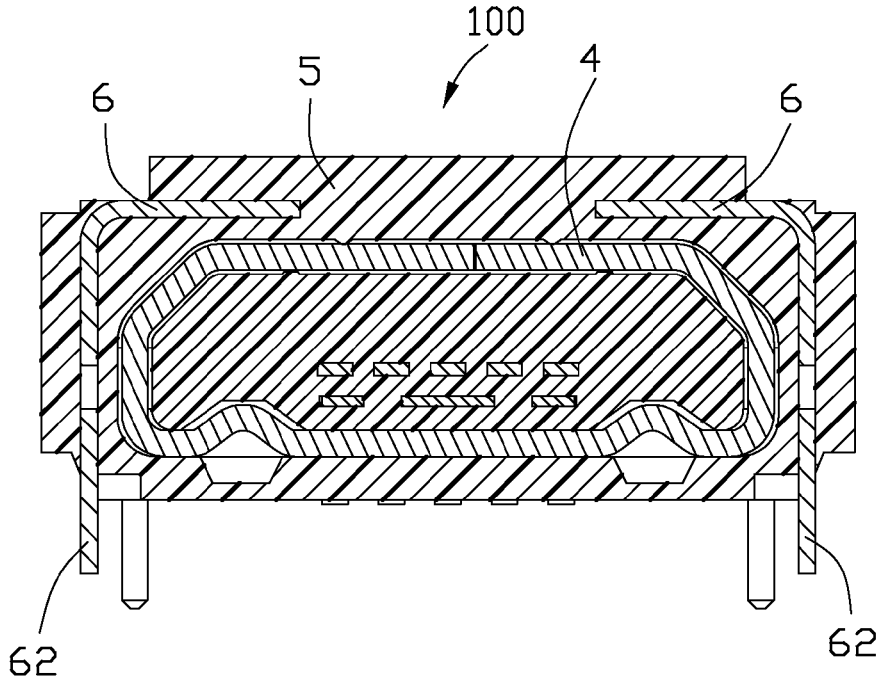
FIG. 5 is a cross-sectional view taken along line 5-5 of FIG. 1.
Figure 6:
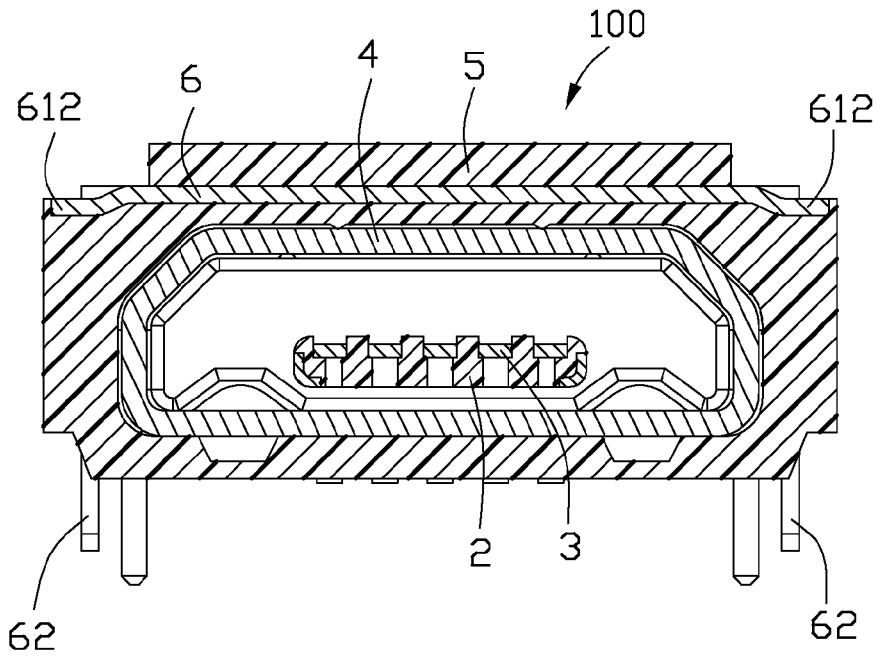
FIG. 6 is a cross-sectional view taken along line 6-6 of FIG. 1.

Referring to FIGS. 3 and 4, the insulative housing 2 comprises a base portion 21 and a tongue portion 22 extending forwardly from the base portion 21. The contacts 3 have a plurality of retaining portions 31 retained in the insulative housing 2, a plurality of contacting portions 32 extending forwardly from the retaining portions 31 to be located beyond the tongue portion 22 for contacting with the mating connector, and a plurality of soldering portions 33 extending rearwardly from the retaining portions 31 to be exposed out of the insulative housing 2 for soldering with a printed circuit board.

Referring to FIGS. 3 and 4, the metal shield 4 is stamped from a metal piece and then crimped into a tube shape. The metal shield 4 comprises a main portion 41 and a pair of board locks 42 extending rearwardly and downwardly from the main portion 41.

Referring to FIGS. 3 and 4, the insulative cover 5 comprises a front portion 51 adjacent to the insertion opening 401 and a rear portion 52 extending rearwardly from the front portion 51. The metal frame 6 is retained in the rear portion 52 of the insulative cover 5. The insulative cover 5 defines an upper face 521, a lower face 522 opposite to the upper face 521, and a pair of lateral faces 523 connecting with the upper face 521 and the lower face 522. The rear portion 52 has a stepped portion 524 at each lateral side thereof. The stepped portion 524 has a height lower than other parts of the rear portion 52.

Referring to FIGS. 3 and 4, the metal frame 6 comprises a transverse arm 61 and a pair of vertical arms 62 extending downwardly from two distal ends of the transverse arm 61. The transverse arm 61 defines a cutout 611 for filling plastic materials and thereby combining the insulative cover 5 and the metal frame 6. The transverse arm 61 comprises two pairs of pin members 612 extending oppositely, outwardly from two ends thereof. Each pair of pin members 612 are respectively located two opposite sides of the corresponding vertical arm 62. The pin members 612 are originally connected with a carrier (not shown) and then formed by cutting from the carrier. The pin members 612 are coplanar with the stepped portions 524 of the insulative cover 5 for positioning the metal frame 6 when insert-moldering the insulative cover 5. Each vertical arm 62 comprises a lower wider portion 622 and an upper narrower portion 621 connecting the lower wider portion 622 with the transverse arm 61. Therefore, a shoulder portion 623 is formed between each side of the lower wider portion 622 and the upper narrower portion 621. Furthermore, each vertical arm 62 defines an aperture 6221. In a preferred embodiment, the apertures 6221 are filled with plastic materials, thereby assisting in combining the insulative cover 5 and the metal frame 6. The pin members 612 and the shoulder portions 623 are wrapped by insulative material during insert-molding the insulative cover 5. The vertical arms 62 extend out of the lower face 522 of the insulative cover 5 for securing to the printed circuit board. Therefore, the electrical connector 100 of the present invention are soldered on the printed circuit board by the soldering portions 33 of the contacts 3 and secured with the printed circuit board by the board locks 42 of the metal shield 4 and the vertical arms 62 of the metal frame 6 to achieve high reliability.

The electrical connector 100 of the present invention can endure high insertion force of the mating connector because the metal frame 6 covers and thereby reinforces the metal shield 4 from left side, right side, and upper side of the metal shield 4 and therefore, the electrical connector 100 can endure high insertion force generated from the mating connector. The electrical connector 100 prevents the metal shield 4 from cracking. The metal frame 6 is insert-molded with the insulative cover 5 which has a better waterproof effect and is further simply manufactured.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing;

a plurality of contacts retained in the insulative housing;

a metal shield covering the insulative housing for defining a receiving space;

an insulative cover insert-molded outside of the metal shield; and a metal frame retained in the insulative cover, the metal frame comprising a transverse arm and a pair of vertical arms extending downwardly from two distal ends of the transverse arm; wherein the insulative cover comprises an upper face, a lower face opposite to the upper face, and a pair of lateral faces connecting with the upper face and the lower face, and the transverse arm is retained in the upper face and the vertical arms are retained in the lateral face; wherein the insulative cover comprises a front portion, a rear portion extending rearwardly from the front portion, and a stepped portion formed on the rear portion with a height lower than other parts of the rear portion, and wherein the metal frame comprises a plurality of pin members coplanar with the stepped portion to expose out of the insulative cover; wherein the pin members comprises at least one pair of pin members respectively located at two opposite sides of the vertical arm; wherein each vertical arm comprises a lower wider portion, an upper narrower portion connecting the lower wider portion with the transverse arm, and a shoulder portion formed between each side of the lower wider portion and the upper narrower portion.

2. The electrical connector as claimed in claim 1, wherein the lower face is adapted for abutting against a printed circuit board.

3. The electrical connector as claimed in claim 1, wherein the vertical arms extend out of the lower face for board locking in a printed circuit board.

4. The electrical connector as claimed in claim 1, wherein the pin members extend oppositely, outwardly from two ends of the transverse arm.

5. The electrical connector as claimed in claim 1, wherein the pin members are formed by cutting from a carrier.

6. The electrical connector as claimed in claim 1, wherein the pin members and the shoulder portions are wrapped by insulative material.

7. The electrical connector as claimed in claim 1, wherein the transverse arm defines a cutout and each vertical arm defines an aperture, and wherein the cutout and the apertures are filled with plastic materials to thereby combine the insulative cover and the metal frame.

8. An electrical connector comprising:

an insulative housing including a base and a mating tongue forwardly extending from the mating tongue;

a plurality of contacts disposed in the housing with contacting sections exposed upon the mating tongue;

a metallic shell assembled to and the housing and enclosing the mating tongue, said shell forming at least a board lock on a rear side for mounting to a printed circuit board;

an insulative cover enclosing the shell; and a metallic bracket mostly embedded within the cover; wherein said bracket is equipped with at least one arm extending downwardly beyond a bottom side of the cover for mounting to the printed circuit board; wherein the board lock is located behind the arm in a front-to-back direction; wherein the board lock is located on an outer side with regard to the arm in a transverse direction perpendicular to said front-to-back direction; wherein the bracket is embedded within the cover via an insert molding process, and an interior side of the cover and an exterior contour of the shell are configured and dimensioned to be snugly coupled with each other so as to allow the shell to be forwardly assembled into the cover from a rear side of the cover, and a glue block is applied upon a rear side of the cover to seal a circumferential gap between the shell and the cover; wherein the bracket further includes a pin member located beside the arm in a front-to-back direction; wherein the bracket has a portion exposed upon a top face of the cover for use with a mold during an insert molding process.

9. An electrical connector comprising:

an insulative housing equipped with a plurality of contacts via an insert molding process;

a metallic shell assembled to the housing;

an insulative cover enclosing the shell;

a waterproof ring attached upon a front edge of the cover;

a glue block attached to a rear side of the cover to seal a circumferential gap between the shell and the cover; and a metallic bracket embedded within the bracket via another insert molding process and defining a U-shaped structure, in a front view, with a pair of arms exposed outside of the cover for mounting to a printed circuit board; wherein the shell further includes a pair of board locks exposed outside of the cover and located behind the pair of arms in a front-to-back direction; wherein the bracket has a portion exposed upon a top face of the cover for use with a mold during the insert molding process; wherein the bracket further includes a pin member located beside the arm in a front-to-back direction.

* * * * *